US005369476A

United States Patent [19]

Bowers et al.

[11] Patent Number: 5,369,476

[45] Date of Patent: Nov. 29, 1994

[54] TONER CONTROL SYSTEM AND METHOD FOR ELECTROGRAPHIC PRINTING

[75] Inventors: Harry Bowers, New York, N.Y.; L. Douglas Clark, San Francisco, Calif.

[73] Assignee: Cactus, Santa Fe Springs, Calif.

[21] Appl. No.: 826,600

[22] Filed: Jan. 28, 1992

[51] Int. Cl.[5] ..... G03G 15/10

[52] U.S. Cl. ..... 355/256; 118/688; 355/208; 430/117

[58] Field of Search ..... 355/208, 246, 256; 118/688, 689, 691; 430/117, 118, 119

[56] References Cited

U.S. PATENT DOCUMENTS

| | | | |
|---|---|---|---|
| 4,277,162 | 7/1981 | Kasahara et al. | 355/208 |
| 4,398,818 | 8/1983 | Jeromin et al. | 355/256 |
| 4,519,695 | 5/1985 | Murai et al. | 355/77 X |
| 4,660,152 | 4/1987 | Downing et al. | 355/246 X |
| 4,671,309 | 6/1987 | Iemura et al. | 137/93 |
| 4,675,696 | 6/1987 | Suzuki | 346/46 |
| 4,827,279 | 5/1989 | Lubinsky et al. | 346/1.1 |
| 4,831,420 | 5/1989 | Walsh et al. | 355/203 |
| 4,894,685 | 1/1990 | Shoji | 355/246 |
| 4,929,978 | 5/1990 | Kanamori et al. | 355/38 |
| 5,001,027 | 3/1991 | Otsuka et al. | 430/31 |
| 5,189,521 | 2/1993 | Ohtsubo et al. | 355/246 X |
| 5,212,029 | 5/1993 | Scheuer et al. | 355/246 X |

FOREIGN PATENT DOCUMENTS

| | | | |
|---|---|---|---|
| 0161180 | 7/1987 | Japan | 355/256 |
| 0131162 | 6/1988 | Japan | 355/256 |

*Primary Examiner*—Leo P. Picard
*Assistant Examiner*—Christopher Horgan
*Attorney, Agent, or Firm*—Flehr, Hohbach, Test, Albritton & Herbert

[57] ABSTRACT

Toner control system and method for an electrographic printer in which toner is delivered from a reservoir to a toner fountain and there applied to an electrostatically charged sheet to form an image. The visual quality of the image is monitored, and toner concentrate is added to the toner in response to the monitored quality to increase the amount of pigment particles in the toner and thereby maintain a substantially constant image quality. The concentrate is added to the toner in a return line between the fountain and the reservoir in relatively small, predetermined amounts, and it is mixed before being added. In the disclosed embodiments, a test image is formed outside the main image on the sheet, and the brightness of one or more predetermined colors in the test image is monitored. This system and method are applicable both to monochrome images and to multicolor images.

22 Claims, 4 Drawing Sheets

TONER CONTROL SYSTEM AND METHOD FOR ELECTROGRAPHIC PRINTING

This invention pertains generally to electrographic printing and, more particularly, to a system and method for adjusting toner concentration to maintain image quality.

In the electrographic printing process, electrostatic charge is applied in an image-wise fashion to the surface of a special electrographic paper. Thereafter, the surface of the paper is washed at a toner fountain with a liquid toner consisting of a thin slurry of pigment particles suspended in a solution of hydrocarbons and various additives. The additives retard agglomeration of the pigment particles, control the electrical conductivity of the toner, retard aging, and so forth. Because they have a net electrical charge, the pigment particles adhere to the charged portions of the paper surface. Where no charge is present, the pigment particles do not adhere. Those which do not adhere rinse off during the toning process and are returned to a toner reservoir.

An electrographic printing machine contains only a finite amount of liquid toner. As pigment particles are deposited on image areas, the concentration of pigment in the toner reservoir decreases. Loss of charge-carrying constituents causes other characteristics of the toner, such as conductivity, to change, too. Below a certain pigment concentration, the toned image becomes visibly fainter, and the liquid toner is said to be depleted. In monochromatic printing applications, a certain latitude in toner concentration can be tolerated, although faint images are generally unacceptable. In multicolor printing applications, depletion of one color component relative to the others can severely and adversely affect the color balance of the printed image.

In the past, when it was noticed that the printed image was faint, a concentrated toner mixture was manually added to the liquid toner reservoir in the electrostatic printing machine, with the amount of toner added being determined by the operator. By periodically adding toner in this manner, it was possible to maintain adequate image quality in monochrome printing applications. However, it was difficult, if not impossible, to maintain accurate color balance in multicolor applications. As a result, no two color images appeared the same, and in cases of relatively long images, the color balance could vary from beginning to end.

In more recent electrographic printing machines, there have been attempts to maintain image quality by the use of optical sensors for monitoring toner concentration, means for automatically adding concentrate when the concentration of toner pigment falls below a threshold level. In one prior art approach, illustrated in FIG. 1, liquid toner is pumped from a main reservoir bottle 11 through a first T-fitting 12, a pump 13 and a second T-fitting 14 to a toner fountain 16 where the charged surface of the electrographic paper is washed with the toner. The toner, minus the pigment particles deposited on the paper surface, returns to the main reservoir through a return line 17.

A sensing line 18 extends from the main reservoir to the center leg of the first T-fitting 12, and a relatively small amount of toner is drawn through the sensing line by the Venturi effect produced by the main toner flow between the reservoir and the fountain. The concentration of the toner in the sensing line is monitored by an optical sensor 19 connected to electronic circuitry (not shown) which produces a signal when the concentration drops below a predetermined threshold level. This signal controls the operation of a solenoid operated valve 21 which is connected between a concentrate reservoir bottle 22 and the center leg of the second T-fitting 14. When the valve is open, concentrate is drawn from reservoir 22 and added to the stream of toner flowing between the main reservoir and the fountain to increase the concentration of pigment particles in the main reservoir.

This system has certain limitations and disadvantages. The vacuum which draws concentrate out of the concentrate reservoir while the solenoid valve is open is dependent upon the rate of toner flow through T-fitting 14, with a higher flow rate producing a greater vacuum and a greater rate of flow from the concentrate reservoir. The pump which circulates the toner is typically driven by a variable speed motor, and this makes it difficult to predict the amount of concentrate that will be added when the solenoid valve is opened for any given period of time. Since the concentrate is added to the toner stream just before it enters the fountain, if any more than a very small amount of concentrate is added at any one time, it will produce an area in the image which is abruptly darker in the added color, and the intensity of color in the image will vary in an unpredictable fashion.

Over time, the various constituents in the concentrate settle to the bottom of the concentrate reservoir, and the amount of pigment and other components added to the toner stream can vary in an unknown manner, depending upon how long the concentrate has remained undisturbed in its reservoir. Also, the amount of pigment which is deposited on the latent charge image on the paper depends to a certain extent on the conductivity of the toner, and using the optical density of the toner stream to determine when pigment particles should be added does not address all of the variables necessary to maintain consistent color density in the toned image.

It is in general an object of the invention to provide a new and improved system and method for controlling toner concentration to maintain image quality in electrographic printing.

Another object of the invention is to provide a system and method of the above character which overcome the limitations and disadvantages of the prior art.

Another object of the invention is to provide a system and method of the above character which are applicable to multicolor printing as well as to monochrome printing.

These and other objects are achieved in accordance with the invention by providing an electrographic printing system and method in which toner is delivered from a reservoir to a toner fountain and there applied to an electrostatically charged sheet to form an image. The visual quality of the image is monitored, and toner concentrate is added to the toner in response to the monitored quality to increase the amount of pigment particles in the toner and thereby maintain a substantially constant image quality. The concentrate is added to the toner in a return line between the fountain and the reservoir in relatively small, predetermined amounts, and it is mixed before being added. In the disclosed embodiments, a test image is formed outside the main image on the sheet, and the brightness of one or more predetermined colors in the test image is monitored. This system and method are applicable both to monochrome images and to multicolor images.

Figure 3A:
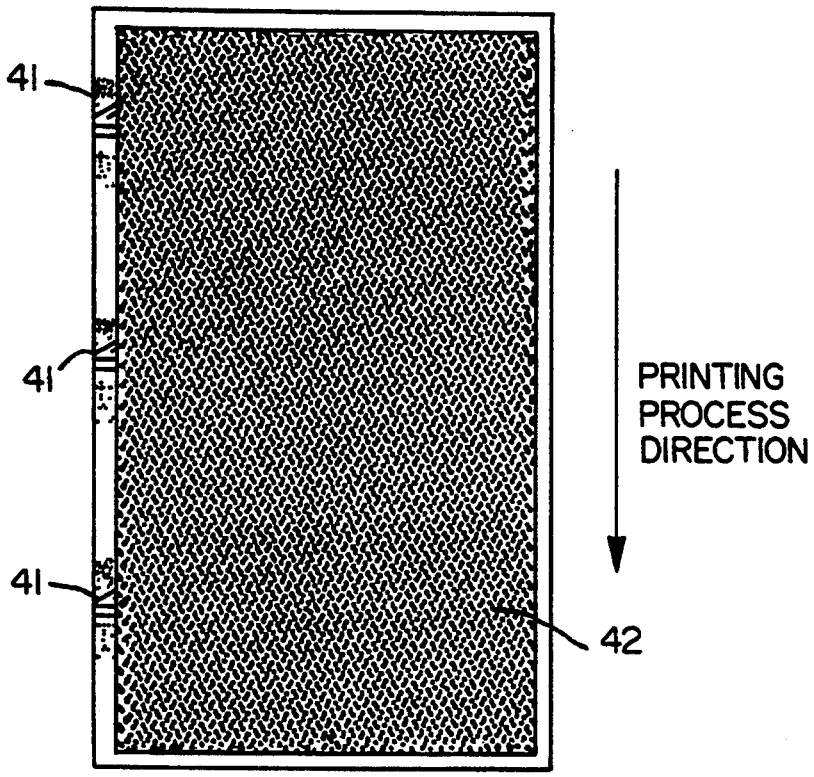
Figure 3B:
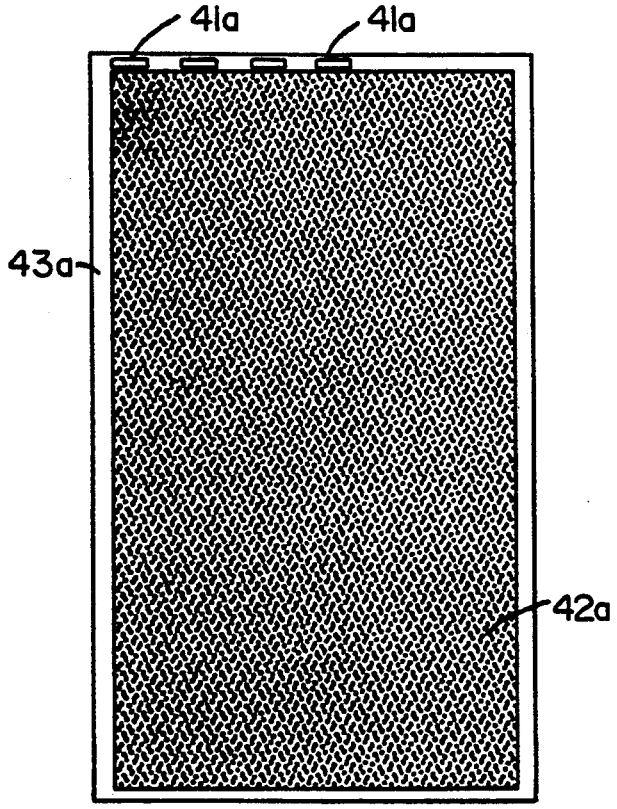

FIGS. 3*a* and 3*b* are plan views of sheets of paper showing the formation of a main image and test images in accordance with the invention.

Figure 4:
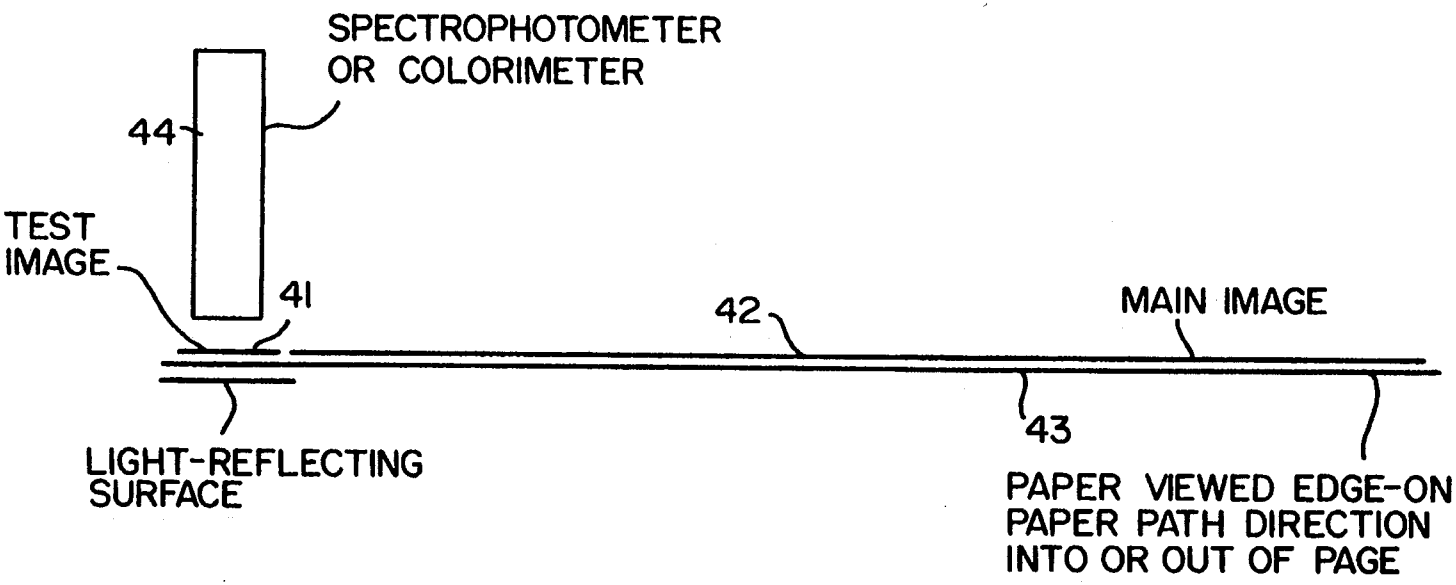

FIG. 4 is a side elevational view, somewhat schematic, illustrating the formation and scanning of test images in accordance with the invention.

Figure 2:
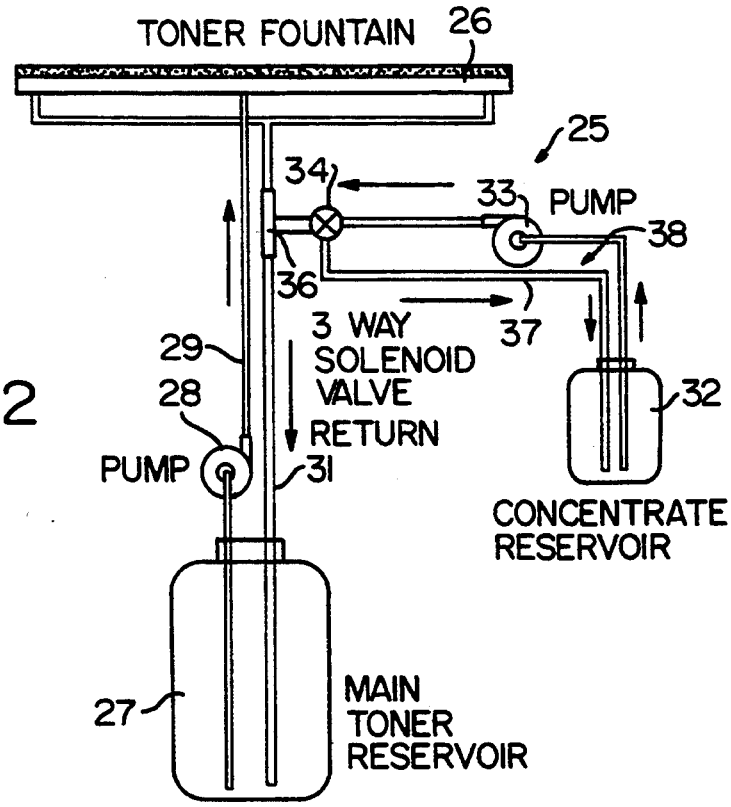
FIG. 2 is a schematic representation of one embodiment of a toner control system for an electrographic printer according to the invention.
Figure 5:
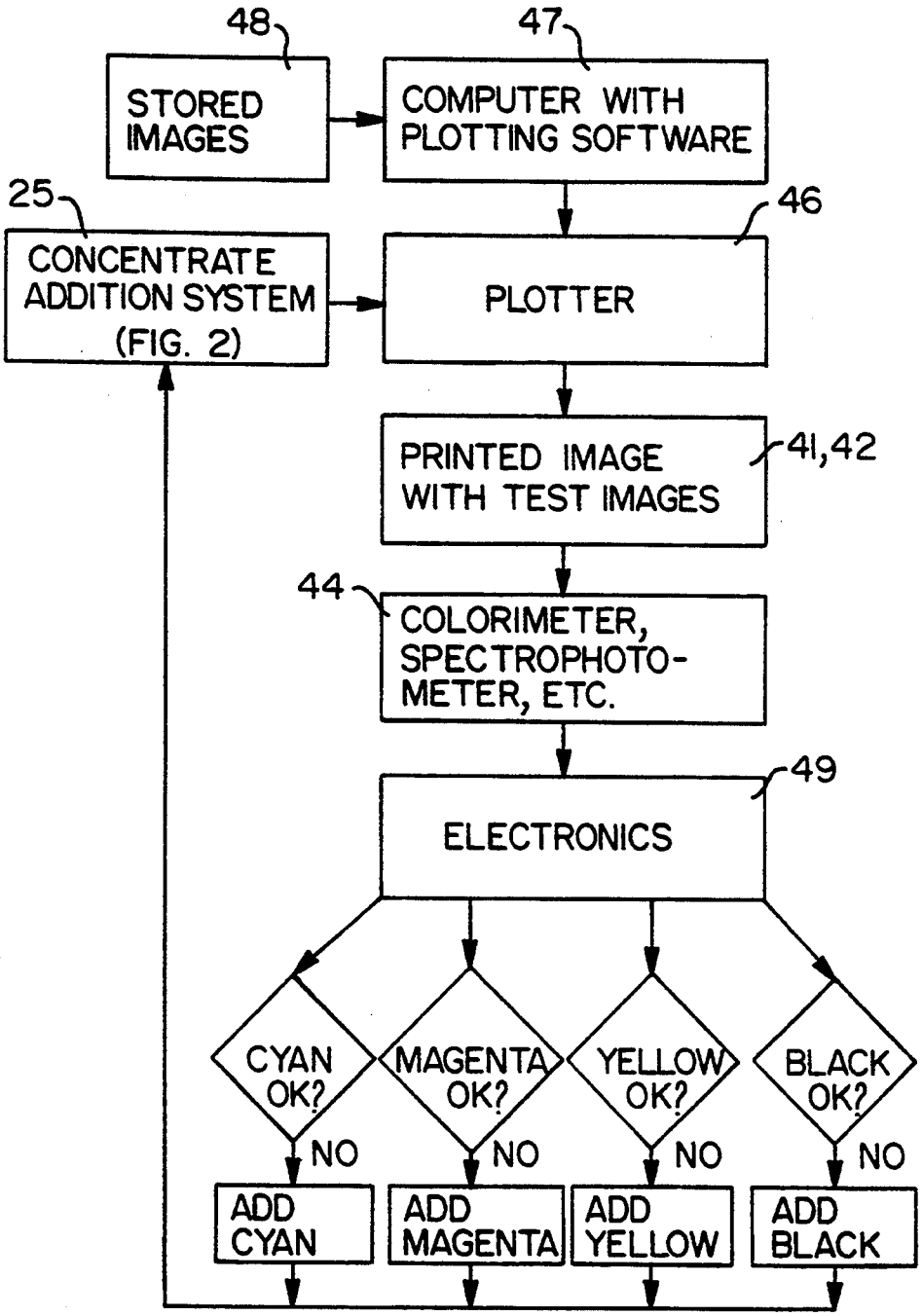

FIG. 5 is a flow chart illustrating the use of the embodiment of FIG. 2 to control the concentration of toner in a computer driven plotter.

Figure 1:
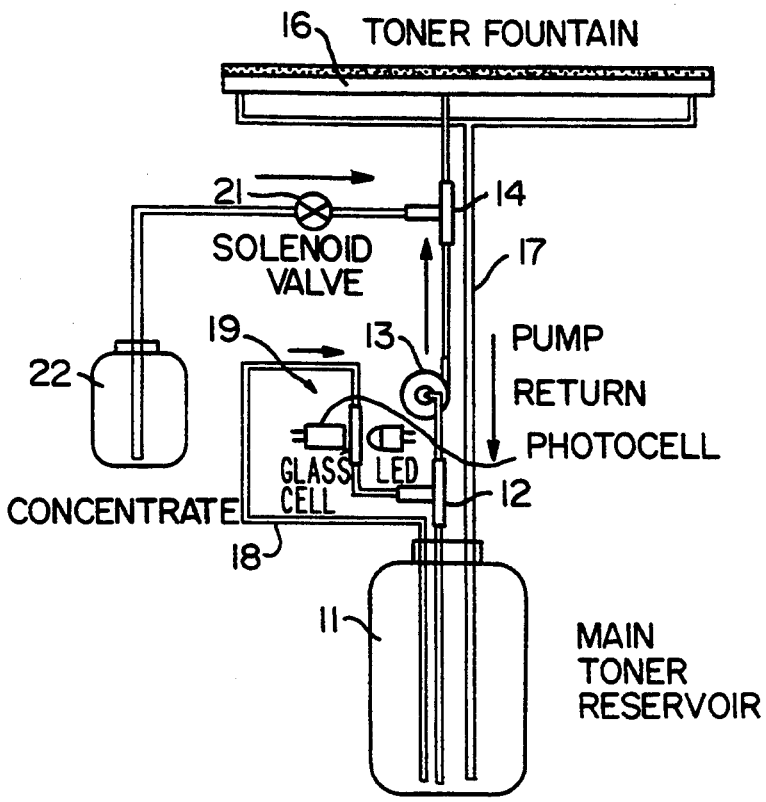
FIG. 1 PRIOR ART
FIG. 1 is a schematic representation of a prior art toner control system for an electrographic printer.

As illustrated in FIG. 2, the toner control system 25 includes a toner fountain 26 to which toner is supplied from a main toner reservoir 27 by a pump 28 and a supply line 29. The unused portion of the toner returns to the reservoir from the fountain through a return line 31. As in the prior art embodiment of FIG. 1, pump 28 can be a variable speed pump.

A concentrated toner mixture ("concentrate") is added to return line 31 to replenish the toner in reservoir 27. The concentrate is delivered to the return line from a concentrate reservoir 32 by a pump 33 and a three-way, solenoid operated valve 34. The discharge side of the pump is connected to the inlet of the three-way valve, and one (normally closed) outlet of the valve is connected to the center leg of a T-fitting 36 in the return line. The second (normally open) outlet of the valve is connected back to the concentrate reservoir by a return line 37 to form a loop 38. Pump 33 is a positive displacement pump, such as a gear pump or a vane pump, which is operated at a predetermined constant speed. The three-way valve is "opened" to connect the outlet of the pump to the T-fitting for brief intervals of predetermined duration, and each time the valve is opened in this manner, pump 33 delivers a known amount of concentrate to the return line. To maintain precise control, the concentrate is preferably injected in relatively small amounts. The concentrate which is injected into return line 31 is thoroughly mixed with the toner in reservoir 27 by the action of pump 28.

When the three-way valve is "closed", the concentrate circulates around loop 38, stirring the concentrate in reservoir 32 to prevent the settling of pigment and other components of the concentrate. If the stirring action is not required at all times, the pump can be actuated just prior to the opening of the three-way valve to stir the concentrate just before it is injected into return line 31.

Image quality is maintained by monitoring this quality directly and controlling the injection of concentrate accordingly. As best seen in FIGS. 3*a–b* and 4, test images 41 are formed outside the main image 42 on paper 43, and the test images are monitored by an optical sensor such 44 as a spectrophotometer, a colorimeter, or the like. In the embodiment shown in FIG. 3*a*, the test images are formed in the margin along one side of the main image, and the sensor scans these images as the sheet travels past the sensor. Monitoring the actual images in this manner and utilizing "image feedback" to control pigment concentration takes account of all of the factors which can affect image quality, and results in substantially more precise image control than simply monitoring the pigment density of the toner. The other factors which can affect image quality include conductivity of the toner, the amount of charge per unit area of latent image, properties of he paper, and humidity. The embodiment of FIG. 3*b* is similar to that of FIG. 3*a* except the test images 41*a* are printed in the top margin of the page 43*a* above the main image 42*a*.

The system shown in FIG. 2 is a monochrome system which has only one concentrate reservoir and one mixer/injector loop. A color system would be identical except it would have a separate concentrate reservoir and loop for each color. A four color system, for example, would have reservoirs and injectors for cyan, magenta, yellow and black concentrates.

In FIG. 5, the toner control system 25 is illustrated in connection with a color plotter 46 and a computer 47. Data for the main image 42 and the test images 41 is supplied to the computer from a hard disk or other suitable storage device 48 and output to the plotter. Each of the four color components (cyan, magenta, yellow and black) in the test images is monitored by the spectrometer or colorimeter 44, and the signals from the spectrometer or colorimeter are processed by electronic circuitry 49 of conventional design to control the operation of the three-way valves in the toner control system. If the brightness of a color is not sufficient, then a signal is sent to the toner control to add a minute amount of concentrate for that color to the toner mixture. The correction process continues until all colors are present in the test images at the desired brightness. With the toner correctly adjusted for the test images, the quality of the main image (i.e., hue, saturation and brightness) is constant and predictable, independent of variables such as toner conductivity, pigment concentration, paper properties, and humidity.

The invention has a number of important features and advantages. The addition of toner concentrate is controlled by scanning actual printed images, and the concentrate is added in relatively small, predetermined amounts. The toner is added to the main reservoir via the return line, and the concentrate is stirred prior to being added to the toner. The printed images are consistent in visual quality from one image to another and from one end to the other in the case of longer images.

It is apparent from the foregoing that a new and improved toner control system and method have been provided. While only certain presently preferred embodiments have been described in detail, as will be apparent to those familiar with the art, certain changes and modifications can be made without departing from the scope of the invention as defined by the following claims.

We claim:

1. In an electrographic printing system: a toner reservoir, a toner fountain for applying toner to an electrostatically charged sheet to form an image, means for delivering toner to the fountain from the reservoir, a source of toner concentrate, means for monitoring an image formed on the sheet to determine image quality, and means responsive to the image quality for adding concentrate to the toner to maintain a substantially constant image quality.

2. The system of claim 1 wherein the means for adding concentrate includes means for adding the concentrate to the toner in relatively small, predetermined amounts.

3. The system of claim 1 including means for mixing the concentrate before it is added to the toner.

4. The system of claim 1 wherein the system includes a return line which carries toner from the fountain back to the reservoir, and the means for adding concentrate to the toner includes means for introducing the concentrate into the return line.

5. The system of claim 1 including means for forming a test image outside a main image on the sheet, the test image being the image which is monitored.

6. The system of claim 1 wherein the means for monitoring the image includes means for monitoring the brightness of a predetermined color in the image.

7. In an electrographic printing method, the steps of: delivering toner from a reservoir to a toner fountain, applying the toner to an electrostatically charged sheet in the fountain to form an image, monitoring an image formed on the sheet to determine image quality, and adding concentrate to the toner in response to the image quality to maintain a substantially constant image quality.

8. The method of claim 7 wherein the concentrate is added to the toner in relatively small, predetermined amounts.

9. The method of claim 7 including the step of mixing the concentrate before it is added to the toner.

10. The method of claim 7 wherein unused toner is returned to the reservoir from the fountain, and the concentrate is added to the toner as it returns to the reservoir.

11. The method of claim 7 wherein a test image is formed outside a main image on the sheet, and the test image is monitored.

12. The method of claim 7 wherein the image quality is determined by monitoring the brightness of a predetermined color in the image.

13. In an electrographic printing system: a toner reservoir, a toner fountain in which toner is applied to an electrostatically charged sheet to form an image, toner supply and return lines extending between the toner reservoir and the fountain, means for circulating toner from the toner reservoir through the supply line to the fountain and from the fountain through the return line to the toner reservoir, a concentrate reservoir, a loop connected to the concentrate reservoir, means for circulating concentrate through the loop from the concentrate reservoir to mix the concentrate in the reservoir, valve means connected between the loop and the the return line for selectively delivering concentrate from the loop to the return line to increase the concentration of toner in the toner reservoir, means for monitoring the visual quality of an image formed on the sheet, and means responsive to the monitored quality for controlling operation of the valve means to control the amount of concentrate delivered to the return line and thereby maintain a substantially constant image quality.

14. The system of claim 13 wherein the means for circulating concentrate through the loop comprises a positive displacement pump operating at a substantially constant speed, and the means responsive to the monitored quality includes means for actuating the valve means to deliver concentrate to the return line for a predetermined period of time.

15. The system of claim 13 including means for forming a test image outside a main image on the sheet, the test image being the image whose quality is monitored.

16. The system of claim 13 wherein the means for monitoring the quality of an image includes means for monitoring the brightness of a predetermined color in the image.

17. In an electrographic printing method, the steps of: circulating toner from a toner reservoir to a toner fountain and from the fountain through a return line back to the toner reservoir, applying the toner to an electrostatically charged sheet in the fountain to form an image, circulating toner concentrate from a concentrate reservoir through a loop and back to the concentrate reservoir to mix the concentrate in the reservoir, monitoring the visual quality of an image formed on the sheet, and delivering concentrate from the loop to the return line in response to the monitored quality to increase the concentration of toner in the toner reservoir and thereby maintain a substantially constant image quality.

18. The method of claim 17 wherein a test image is formed outside a main image on the sheet, and the quality of the test image is monitored.

19. The method of claim 17 wherein the quality of the image is monitored by monitoring the brightness of a predetermined color in the image.

20. The method of claim 19 wherein the concentrate is circulated through the loop by a positive displacement pump operating at a substantially constant speed, and the concentrate is delivered from the loop to the return line for a predetermined period of time.

21. In an electrographic printing system: a toner reservoir, a toner fountain in which toner is applied to an electrostatically charged sheet to form an image, toner supply and return lines extending between the toner reservoir and the fountain, means for circulating toner from the toner reservoir through the supply line to the fountain and from the fountain through the return line to the toner reservoir, a concentrate reservoir, a loop connected to the concentrate reservoir, means for circulating concentrate from the concentrate reservoir through the loop and back to the concentrate reservoir to mix the concentrate in the concentrate reservoir, and means connected between the loop and the return line for selectively delivering concentrate from the loop to the return line to increase the concentration of toner in the toner reservoir.

22. In an electrographic printing method, the steps of: circulating toner from a toner reservoir to a toner fountain and from the fountain through a return line back to the toner reservoir, applying the toner to an electrostatically charged sheet in the fountain to form an image, circulating toner concentrate from a concentrate reservoir through a loop and back to the concentrate reservoir to mix the concentrate in the concentrate reservoir, and delivering concentrate from the loop to the return line to increase the concentration of toner in the toner reservoir and thereby maintain a substantially constant quality in the image formed on the sheet.

* * * * *